United States Patent [19]

Mowry, Jr.

[11] Patent Number: 4,662,651

[45] Date of Patent: May 5, 1987

[54] DOCUMENT PROTECTION USING MULTICOLOR CHARACTERS

[75] Inventor: William H. Mowry, Jr., Ionia, N.Y.

[73] Assignee: The Standard Register Company, Dayton, Ohio

[21] Appl. No.: 739,847

[22] Filed: May 31, 1985

[51] Int. Cl.[4] ..... B42D 15/02; G09F 3/03

[52] U.S. Cl. ..... 283/70; 283/74; 283/95; 283/57; 283/58; 400/103; 400/241.2

[58] Field of Search ..... 283/72, 85, 94, 95, 283/57, 58, 59, 70, 74; 428/915; 400/103-108, 241.1, 241.2

[56] References Cited

U.S. PATENT DOCUMENTS

| | | | |
|---|---|---|---|
| 3,560,229 | 2/1971 | Farnham et al. | 106/21 |
| 3,682,673 | 8/1972 | Manske | 283/95 |
| 4,172,605 | 10/1979 | Welsch et al. | 282/27.5 |
| 4,425,386 | 1/1984 | Chang | 427/256 |
| 4,496,961 | 1/1985 | Devrient | 283/74 X |

FOREIGN PATENT DOCUMENTS 664456 1/1952 United Kingdom .

OTHER PUBLICATIONS

Research Disclosure (Nov. 1979).

*Primary Examiner*—Howard N. Goldberg
*Assistant Examiner*—Taylor J. Ross
*Attorney, Agent, or Firm*—Killworth, Gottman, Hagan & Schaeff

[57] ABSTRACT

Apparatus and method for protecting a document against unauthorized alteration comprising providing, on localized areas of a substrate, a self-contained chemical system which can produce an authorized visible message when subjected to impact pressure, and the same chemical system produces an unauthorized warning indication when any attempt is made to mechanically alter the authorized visible message.

7 Claims, 4 Drawing Figures

DOCUMENT PROTECTION USING MULTICOLOR CHARACTERS

BACKGROUND OF THE INVENTION

Many methods are known to protect documents from alteration; however, none of these methods is completely satisfactory, and improvements are always needed. The present invention provides such improvements in document protection by providing a document using self-contained, pressure-sensitive imaging material to form the desired authentic characters and to create evidence of attempted alteration of the authentic characters.

DESCRIPTION OF THE INVENTION

Figure 1:
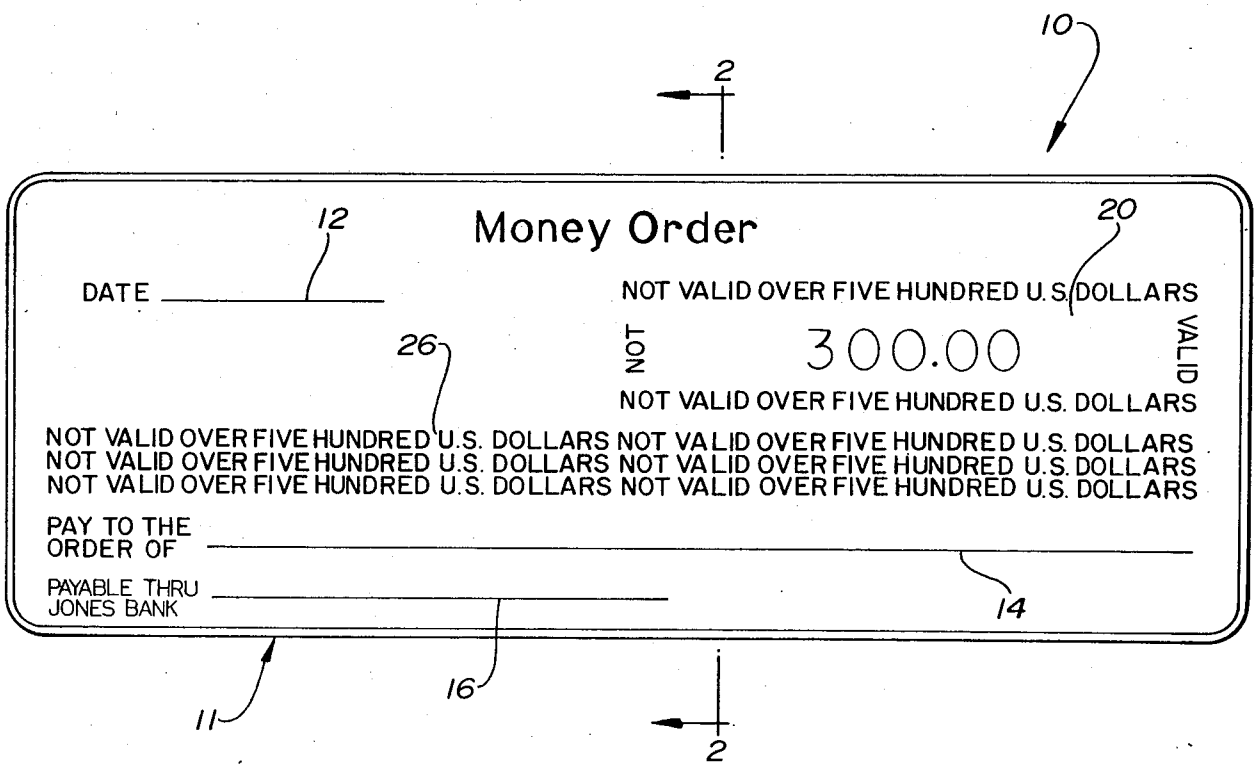
FIG. 1 is a plan view of a document embodying the invention.

Referring to FIG. 1, a document 10, for example, a travelers check, money order, or the like, comprises a sheet of paper 11 which bears the usual printed material on its front surface or face. For example, a money order might include a line 12 for date, a line 14 for the payee's name, and a line 16 for the payor's signature. The document also has an area 20, on which the numbers for the amount to be paid appear. This area 20 may also be surrounded by printing such as "not valid over 500 dollars", for example. There may also be an area 26 of several lines which extend across the document and carry a message also limiting the maximum amount to be paid on the document. The exact amount to be paid may be typed in this area using words and numbers.

According to the invention, the document 10 is coated on its front face on the area 20, with a layer 50 of a pressure-sensitive, image-forming chemical system. For extra protection, the area 26 may also be coated. The layer 50 contains a first free chemical substance, a developer, and a second chemical substance which is a color former and is held immobilized in frangible capsules. When the capsules are broken by the application of pressure by a printer, the color former unites with the developer to form an imaging material which provides a visible authorized message as determined by the printer.

The chemical developer may be a phenolic resin, and the encapsulated color former material may be crystal violet lactone. The material of layer 50 may also be any well known material such as that used in CLT paper made by Burroughs Corporation, or it may be generally of the type described in U.S. Pat. No. 4,010,292 of Shackle et al and U.S. Pat. No. 4,197,346 of Stevens, which are incorporated herein by reference.

The layers 50 are placed on sheet 11 by any suitable coating or printing process.

Figure 3:
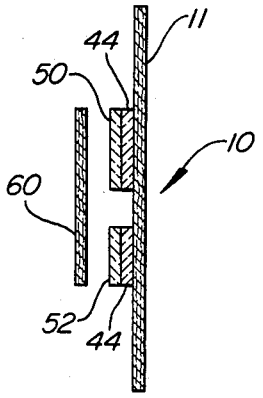
FIG. 3 is a sectional view, similar to that of FIG. 2, illustrating a modification of the invention.

Alternatively, referring to FIG. 3, the self-contained imaging material may be provided in two separate layers, first layers 44 of one chemical, the developer, and then layers 52 of the encapsulated chemical color former which can react with the material of layers 44 to provide the desired visible image.

In using the document 10, of either form, an impact printer is used to print the desired numerals and characters in the spaces 20 and 26, and the pressure of the printer on the capsules in the layers 50 or 52 causes the encapsulated chemical color former to be released and react with the other chemical developer to form the printed numerals and characters. Any subsequent attempt at alteration by the application of pressure of any kind releases more of the encapsulated chemical in layers 50 and 52, and this will react with the chemical developer and form a smudge around the original printing, and, of course, this will be immediately visible.

Figure 2:
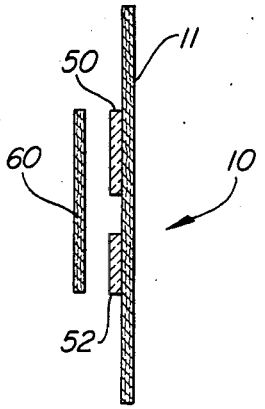
FIG. 2 is a sectional view along the lines 2—2 in FIG. 1 with a print ribbon associated with the document.

Alternatively, according to the invention, in using the document 10 and as illustrated in FIGS. 2 and 3 a standard printing ribbon 60, like a typewriter ribbon, is used in the printing process to add the pigment and/or dyes from the ribbon to the chemicals in layers 44, 50, and 52 to thus provide a unique combined color resulting from the combination of the two separate images. Unauthorized modification of the uniquely colored printed numerals would be extremely difficult to accomplish without the alteration being obvious.

To further enhance the protective powers of the invention, a special ribbon 60 may be provided with checkwriter-like inks combined with another color former which combines with excess developer of layer 50 to provide another visible image of exotic or unusual hue that may appear as a halo around the primary authorized ink image. This would be even more difficult to alter or duplicate in combination with the two previously described overlapping images.

Several color combinations are possible, for example:

1. The ribbon 60 itself may carry an ink of any suitable color.
2. The ribbon may carry the same color former substance as the capsules in layer 50.
3. The ribbon may carry an ink of any suitable color plus the same color former as in the capsules.

Figure 4:
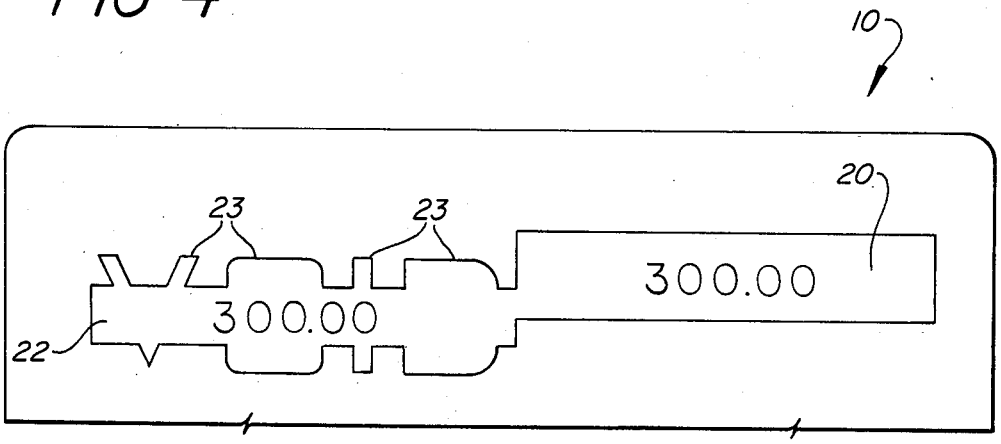
FIG. 4 is a plan view of a portion of a modification of a document embodying the invention.

In a modification of the invention shown in FIG. 4, an area including the space 20 and a lateral strip area 22 on sheet 11 are coated with a layer of self-contained, image-forming material like layer 50. The space 22 also includes portions 23 which, combined with space 20, form the word "void" and are also coated. A dollar value is printed in spaces 20 and 22, and, if an attempt at alteration is made, the self-contained chemicals will be released and will cause the word "void" to become visible in color.

What is claimed is:

1. A method of protecting a document comprising: providing a substrate.

providing on said substrate a pressure-sensitive, image-forming layer including a first colorless color former capable of forming a color and a color developer capable of developing the colored form of said first color former on the application of pressure to said pressure-sensitive, image-forming layer, providing a printing ribbon, providing on said printing ribbon a visible color-containing ink and a second colorless color former capable of reacting with said color developer to develop the colored form of said second color former, and forming a composite image having a halo around it on the upper surface of said substrate by applying localized pressure through said ribbon to combine said first color former, said color developer, said color-containing ink, and said second color former.

2. The method of claim 1 wherein said second color former is capable of forming a color different from said first color former whereby a halo of a different color is formed around said composite image.

3. A document protection system for protecting a document against alteration comprising:

a document including a substrate and a pressure-sensitive, image-forming layer on the upper surface of said substrate, said pressure-sensitive, image-forming layer including a first colorless color former capable of forming a color and a color developer capable of developing the colored form of said first color former on the application of pressure to said pressure-sensitive, image-forming layer, and a printing ribbon comprising a ribbon member, a visible color-containing ink and a second colorless color former capable of reacting with said color developer to develop the colored form of said second color former, whereby said first color former, said color developer, said color-containing ink, and said second color former are combinable to form a composite image having a halo around it on the upper surface of said document.

4. The document protection system of claim 3 wherein said second color former is capable of forming a color different from said first color former whereby a halo of a different color is formed around said composite image.

5. A printing ribbon capable of aiding in the protection against alteration of a document having on its surface a color developer capable of developing the colored form of a colorless color former, the printing ribbon comprising:

a ribbon member, a visible color-containing ink on said ribbon member capable of imparting a color to a document when said ink is deposited on said document, and a colorless color former on said ribbon member, said color former being capable of reacting with a color developer material on the surface of the document to develop the colored form of said color former when said color former is deposited on said document along with said ink.

6. The printing ribbon of claim 5 wherein the color imparted to the document by said color former is a color different than the color imparted by said ink.

7. The printing ribbon of claim 6 wherein the color imparted to the document by said color former is capable of combining with the color imparted by said ink to form a color different than either the color imparted by said ink or the color imparted by said color former.

* * * * *